US006447380B1

(12) United States Patent
Pham et al.

(10) Patent No.: US 6,447,380 B1
(45) Date of Patent: Sep. 10, 2002

(54) POLISHING APPARATUS AND SUBSTRATE RETAINER RING PROVIDING CONTINUOUS SLURRY DISTRIBUTION

(75) Inventors: Xuyen Pham, Fremont; Joe Simon, Newark, both of CA (US)

(73) Assignee: Lam Research Corporation, Fremont, CA (US)

( * ) Notice: Subject to any disclaimer, the term of this patent is extended or adjusted under 35 U.S.C. 154(b) by 0 days.

(21) Appl. No.: 09/607,896

(22) Filed: Jun. 30, 2000

(51) Int. Cl.[7] ..... B24B 37/04
(52) U.S. Cl. ..... 451/288; 451/398
(58) Field of Search ..... 451/286, 285–289, 451/60, 446, 398, 388

(56) References Cited

U.S. PATENT DOCUMENTS 5,571,044 A 11/1996 Bolandi et al.
5,692,947 A 12/1997 Talieh et al.
5,695,392 A * 12/1997 Kim ..... 451/288
5,803,799 A 9/1998 Volodarsky et al.
5,857,899 A 1/1999 Volodarsky et al.
6,019,670 A * 2/2000 Cheng et al. ..... 451/56
6,110,025 A * 8/2000 Williams et al. ..... 451/286
6,146,260 A * 11/2000 Yi ..... 451/398
6,179,694 B1 * 1/2001 Quek ..... 451/286
6,267,643 B1 * 7/2001 Teng et al. ..... 451/41
6,277,008 B1 * 8/2001 Masuta et al. ..... 451/286

* cited by examiner

*Primary Examiner*—George Nguyen
(74) *Attorney, Agent, or Firm*—Brinks Hofer Gilson & Lione

(57) ABSTRACT

A polishing apparatus includes a rotatable head assembly including a substrate retainer that incorporates a cavity in the face surface of the substrate retainer for temporarily holding polishing slurry during operation of the polishing apparatus. The cavity resides in the face surface of the substrate retainer at a location adjacent the perimeter surface of the retainer. During operation of the polishing apparatus, slurry flowing along the surface of the polishing pad flows into the cavity where a portion of the slurry is temporarily held. As the head assembly of the polishing apparatus rotates against the polishing pad, slurry continuously flows from the cavity across the polishing pad and is uniformly distributed across the exposed surface of the substrate being polished. An offset in the cavity wall permits used slurry to flow away from the substrate retainer during rotation of the head assembly.

19 Claims, 5 Drawing Sheets

POLISHING APPARATUS AND SUBSTRATE RETAINER RING PROVIDING CONTINUOUS SLURRY DISTRIBUTION

FIELD OF THE INVENTION

This invention relates generally to polishing equipment and, more particularly, to polishing heads and head sub-assemblies for use with semiconductor polishing equipment.

BACKGROUND OF THE INVENTION

Semiconductor wafer polishing apparatus are well-known in the art and are conventionally used to planarize a semiconductor wafer in a process known as chemical-mechanical-polishing (CMP). Such polishing apparatus typically include one or more polishing heads, each of which supports a respective semiconductor wafer and positions the wafer adjacent a polishing surface, such as a polishing pad. The polishing head is moved relative to the polishing pad and a suitable polishing slurry is introduced between the wafer and the pad.

Typically, a polishing head includes a central substrate carrier which is surrounded by a substrate retainer. The substrate carrier and the substrate retainer cooperate to form a substrate-receiving pocket that prevents the substrate from moving laterally with respect to the polishing head during polishing operations. To polish the surface of a substrate, the wafer carrier is brought into contact with the polishing pad. Exposed surface layers of the substrate are removed by a combination of chemical reaction and frictional forces brought to bear upon the substrate surface. The frictional forces are created by relative movement of the polishing head and the polishing pad. For example, in one common arrangement, the polishing head is rotated about a rotational axis while the polishing pad undergoes lateral translation relative to the rotating polishing head. Both the polishing head and the polishing pad are placed in rotational motion.

During polishing operations, it is important that an adequate supply of slurry be maintained between the substrate and the polishing pad. It is of considerable importance that the wafer polishing machine be able to planarize substantially the entire exposed surface of the substrate. Difficulty often arises with respect to the marginal edge of the substrate, which can often be polished at a rate that is different than the center of the substrate. If the polishing rate at the periphery of the wafer differs excessively from the polishing rate at the center of the wafer, the periphery of the substrate may not be suitable for use in subsequent semiconductor processing stages. The edge-to-center polishing uniformity can be affected by a variance in the amount of slurry at the center of the substrate versus the periphery of the substrate. In order to provide a uniform amount of slurry between the substrate and the polishing pad, polishing equipment manufacturers have developed various techniques for delivering slurry to the polishing pad. For example, one or more nozzles can be provided within the polishing head to deliver slurry to the polishing pad.

In one method, one or more slurry nozzles are mounted near the perimeter of the polishing head and slurry is dispensed onto the polishing pad during rotation of the polishing head. Despite the application of slurry nozzles to the polishing head, non-uniform polishing of semiconductor substrates continues to be a problem in polishing operations. Accordingly, further development of the polishing equipment is necessary to provide more uniform substrate polishing.

BRIEF SUMMARY OF THE INVENTION

In accordance with one aspect of the invention, a polishing apparatus includes a polishing pad and a polishing head assembly coupled to a rotatable shaft. A retainer is engaged with the head assembly such that a substrate is held against a substrate carrier mounted to the polishing head. The retainer ring has a face surface opposite the surface of the polishing table. When a polishing slurry is applied to the surface of the polishing pad, a portion of the slurry flows into the cavity such that, during operation of the polishing apparatus, slurry continuously flows from the cavity onto the polishing table. The continual release of polishing slurry from the cavity provides a uniform amount of slurry between the substrate and the polishing table during operation of the polishing apparatus.

In another aspect of the invention, a polishing head assembly is provided that includes a substrate carrier having an annular indentation at the perimeter of the substrate carrier. A substrate retainer is positioned within the annular indentation such that a face surface of the retainer is positioned opposite a polishing pad. The face surface has a cavity that is configured to cooperate with a polishing surface in contact with the face surface to provide a liquid reservoir. The substrate carrier is configured to move in relation to a polishing surface that supports a polishing slurry. The cavity retains a portion of the polishing slurry during the movement of the substrate carrier. An offset in the cavity wall permits used slurry to flow away from the substrate retainer during rotation of the head assembly.

In yet another aspect of the invention, a substrate retainer for use in a polishing apparatus includes a continuous annular member having a face surface and a perimeter surface. A cavity resides in a portion of the face surface in proximity to the perimeter surface of the annular member.

The cavity in the annular member can have several different geometric configurations, such as a hollowed-out region in the face surface, an elongated channel, and the like. Further, a plurality of cavities can reside in the face surface of the annular member in which each cavity is separated by a non-cavity containing portion of the face surface.

Figure 1:
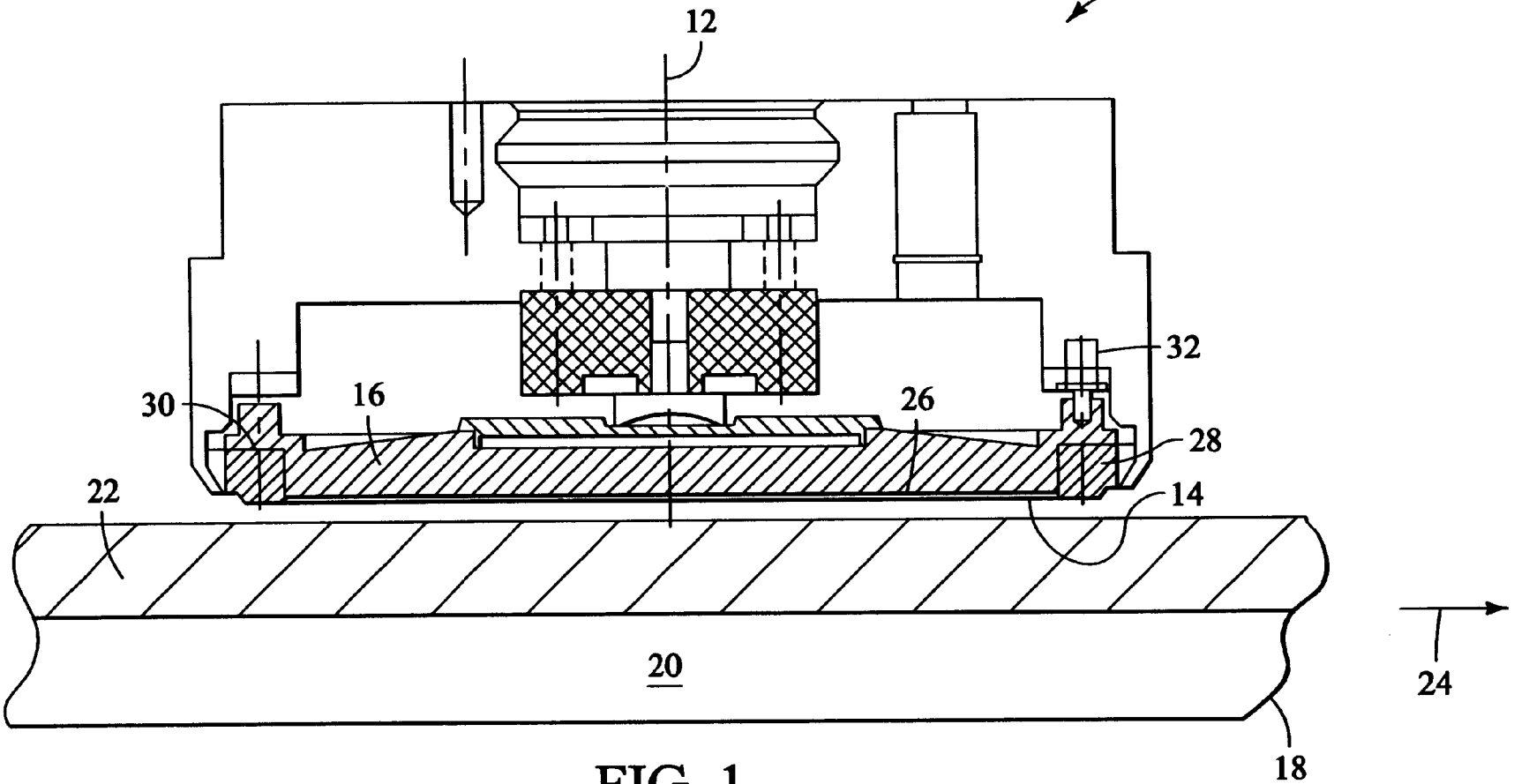
FIG. 1 illustrates, in cross-section, a portion of a substrate polishing head assembly arranged in accordance with one embodiment of the invention.

It will be appreciated that, for simplicity and clarity of illustration, elements shown in the FIGURES have not necessarily been drawn to scale. For example, the dimensions of some of the elements are exaggerated relative to each other for clarity. Further, where considered appropriate, reference numerals have been repeated among the FIGURES to indicate corresponding elements.

DETAILED DESCRIPTION OF THE PREFERRED EMBODIMENTS

FIG. 1 illustrates a cross-sectional view of a portion of a polishing head assembly 10. Polishing head assembly 10 is configured to rotate about a rotational axis 12. A substrate 14 is positioned against a substrate carrier 16 in the lower portion of polishing head assembly 10. Substrate 14 can be any material requiring polishing, including a semiconductor substrate, a refractory metal substrate, a metal alloy substrate, and the like.

In a preferred embodiment of the invention, polishing head assembly 10 is configured for polishing a semiconductor substrate having any of several different thin film materials thereon. For example, substrate 14 can be a semiconductor substrate having a thick dielectric material, such as silicon oxide thereon. Further, semiconductor substrate 14 can be a semiconductor substrate having a semiconductive material, such as polycrystalline silicon, a refractory metal silicide, amorphous silicon, and the like thereon. Also, substrate 14 can be a semiconductive substrate having electrically conductive metals, such as aluminum, aluminum-silicon alloys, copper, copper alloys, and the like thereon.

Also shown in FIG. 1 is a portion of a polishing pad 18. Polishing pad 18 can be one of a number of different types of polishing pads commonly used in a (CMP) apparatus. For example, polishing pad 18 can be a polyurethane material and the like. Generally, polishing pad 18 includes a support layer 20 and a polishing surface layer 22.

During operation, polishing pad 20 is engaged in relative motion to polishing head assembly 10. For example, in one common CMP apparatus, polishing pad 18 moves in a lateral direction, as indicated by arrow 24, while head assembly 10 rotates about rotational axis 12. A slight downward pressure is exerted upon head assembly 10 to cause substrate 14 to come into contact with polishing surface layer 22 of polishing pad 18.

Substrate 14 is positioned against a substrate support surface 26 of substrate carrier 16. A substrate retainer 28 surrounds substrate support surface 26 and protrudes below substrate support surface 26 by an amount sufficient to form a continuous surface with substrate 14. By extending below substrate support surface 26 of substrate carrier 16, substrate retainer 28 cooperates with substrate carrier 16 to form a substrate receiving area in which substrate 14 is contained during polishing operations.

Substrate retainer 28 is positioned within an annular indentation 30 located at the perimeter of substrate carrier 16. In one embodiment of the invention, substrate retainer 28 is attached to substrate carrier 16 by a torque pin 32. Although only one torque pin is shown, those skilled in the art will appreciate that two or more pins are typically used to couple the substrate retainer to the head assembly. Torque pin 32 allows for relative movement of substrate carrier 16 relative to the remaining structure of polishing head assembly 10. Alternatively, substrate retainer 28 can be flexibly attached to substrate carrier 16 by a clip or other fastening mechanisms.

Figure 2A:
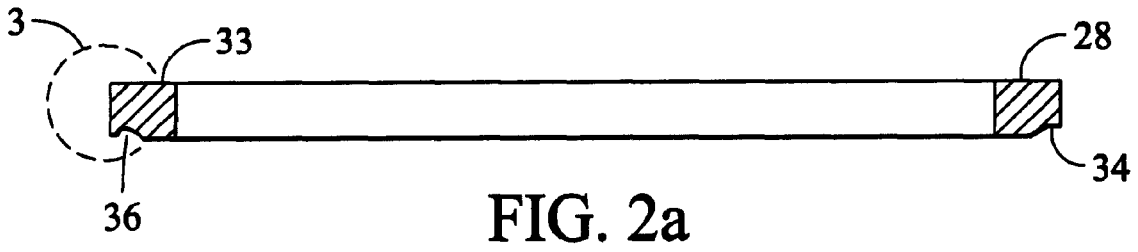
FIG. 2*a* illustrates, in cross-section, a substrate retainer in accordance with one embodiment of the invention.
Figure 2B:
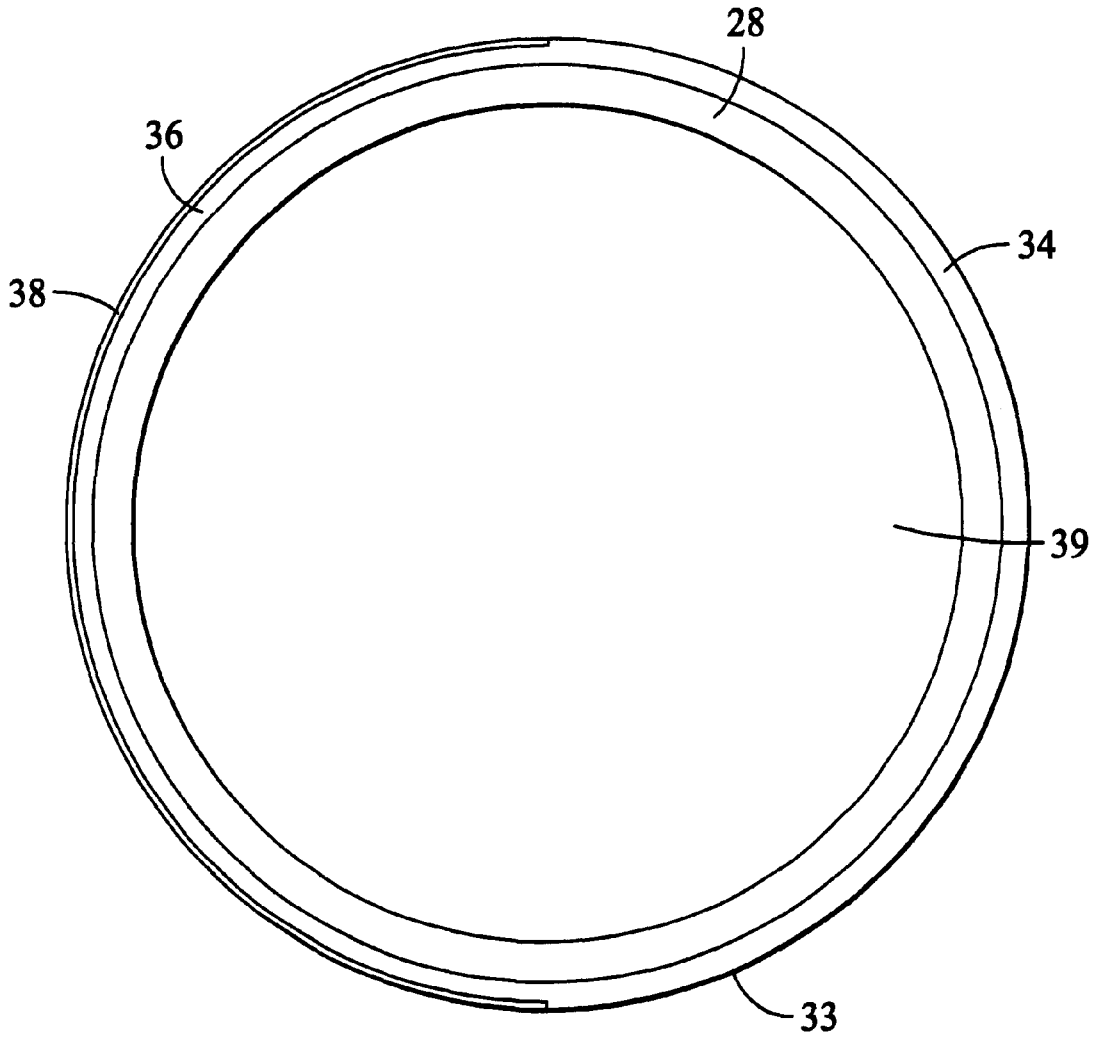
FIG. 2*b* is a bottom view of the substrate retainer illustrated in FIG. 2*a;*

Shown in FIG. 2*a* is a cross-sectional view of substrate retainer 28. Substrate retainer 28 includes an annular member 33 having a recessed surface portion 34. In accordance with the invention, annular member 33 also includes a cavity 36 that is formed in a portion of annular member 33. As shown in the bottom view of FIG. 2*b*, cavity 36 resides in a recessed surface portion 34 and is formed by a lip 38 that extends about a portion of the perimeter of annular member 33. Annular member 33 defines a central opening 39 for receiving substrate 14.

Figure 3:
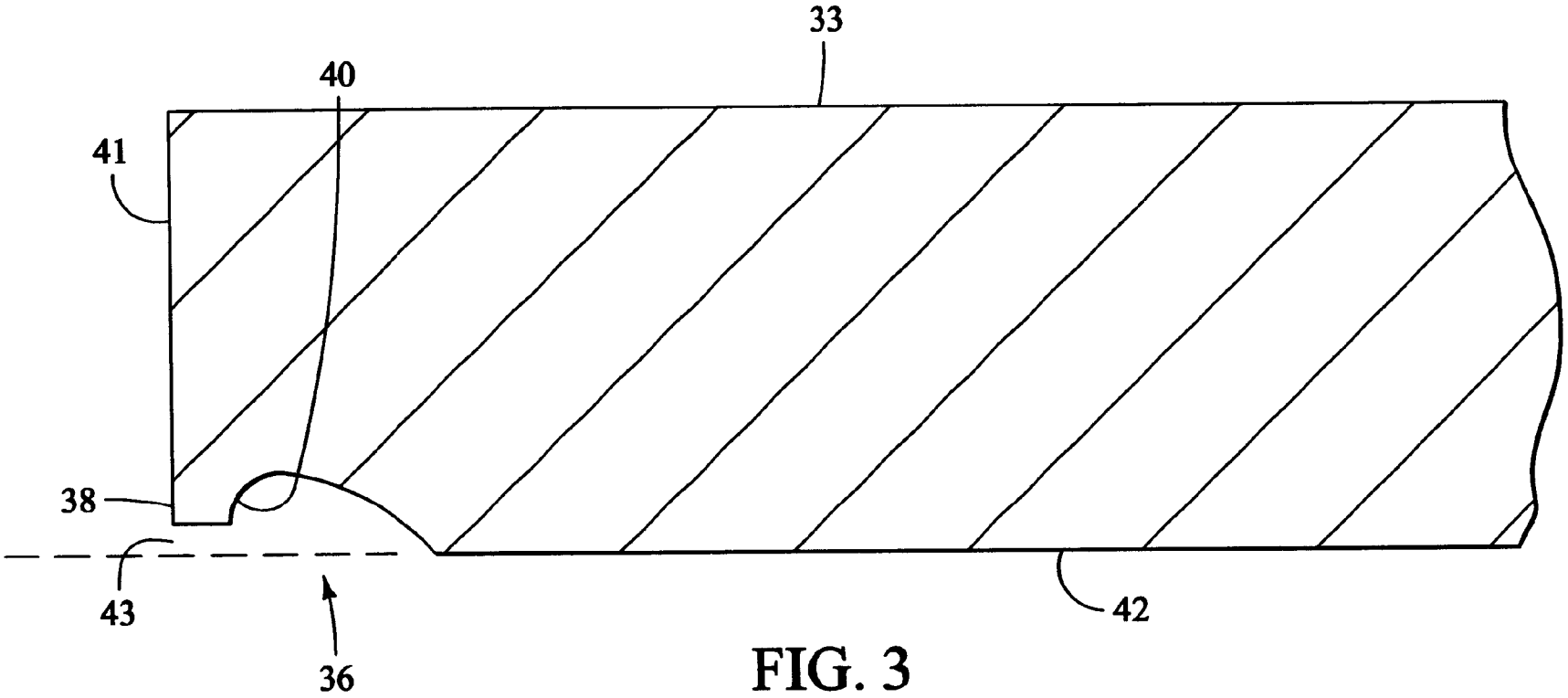
FIG. 3 is an exploded view of a portion of the substrate retainer illustrated in FIG. 2*a;*

An exploded view of a portion of annular member 33 is illustrated in cross-section in FIG. 3. Lip 38 forms a distal wall surface 40 of cavity 36 on a first side and a portion of a perimeter surface 41 on a second side. Annular member 33 also includes a face surface 42 that contacts polishing layer 22 during operation of the CMP apparatus. More importantly, lip 38 does not form a continuous surface with face surface 42. As shown in FIG. 3 by the line laterally extended from face surface 42, the lower portion of lip 38 is offset from face surface 42. The offset forms a gap 43 between the bottom of lip 38 and any flat surface coming into contact with face surface 42. As will subsequently be described, gap 43 plays an important roll in the distribution of slurry during operation of the CMP apparatus.

Figure 4C:
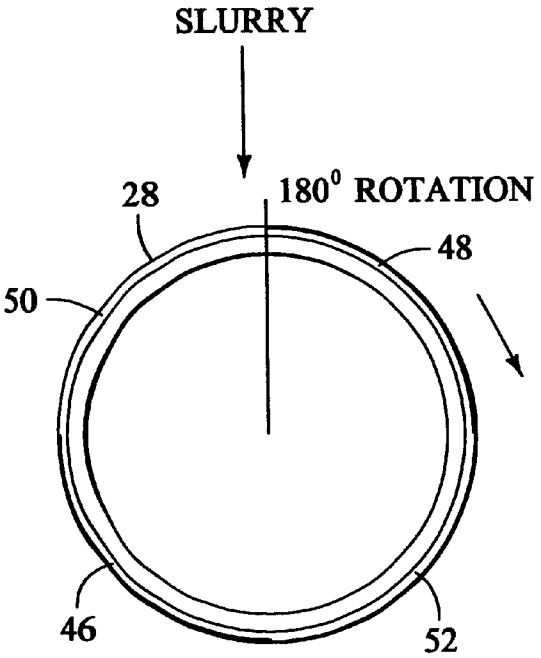
FIGS. 4*a–c* are bottom views of a substrate retainer arranged in accordance with another embodiment of the invention in successive stages of rotation.
Figure 4B:
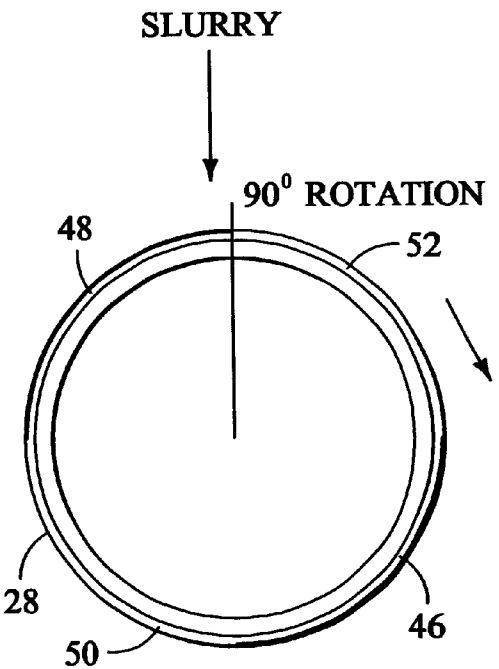
Figure 4A:
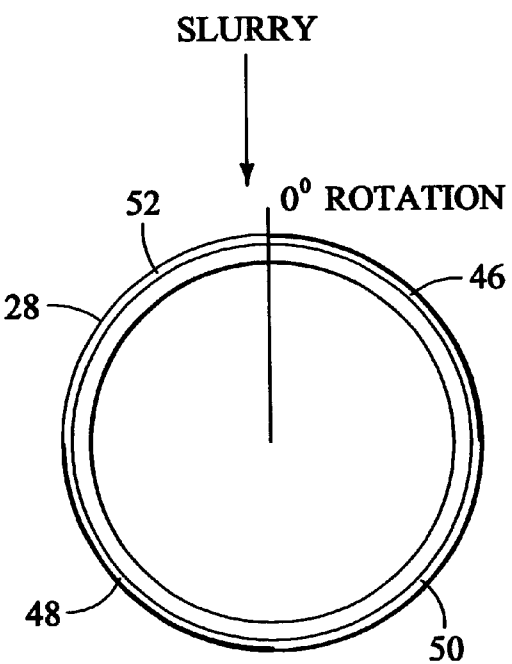

A bottom view of substrate retainer 28 in successive stages of rotation is illustrated in FIGS. 4*a*–4*c*. In the illustrated embodiment, two cavities are formed in the substrate retainer. In accordance with the illustrative embodiment, substrate retainer 28 has cavity 36 and a cavity 48. Cavity 36 is separated from cavity 48 by non-cavity portions 50 and 52 of substrate retainer 28.

In accordance with the invention, during operation of a CMP apparatus, a polishing slurry is introduced onto the polishing pad. A typical polishing slurry is an aqueous composition including an abrasive material, surfactants and can include chemicals that react with the thin film materials formed on the surface of substrate 14.

As illustrated in FIGS. 4*a*–4*c*, the slurry is depicted as undergoing a translational motion relative to the rotational motion of substrate retainer 28. As substrate retainer 28 rotates, a portion of the slurry is captured within first and second cavities 36 and 48. By capturing a portion of the slurry, slurry reservoirs are created at the perimeter of substrate retainer 28. First and second cavities 36 and 48 are configured such that slurry continuously flows from first and second cavities 36 and 48 onto the polishing pad. By providing the continuous flow of slurry, first and second cavities 36 and 48 assist in the distribution of the slurry during polishing operations. In particular, the continuous flow of slurry provided by first and second cavities 36 and 48 enables a more uniform polishing operation by uniformly distributing the slurry across the face of substrate 14.

Figure 5:
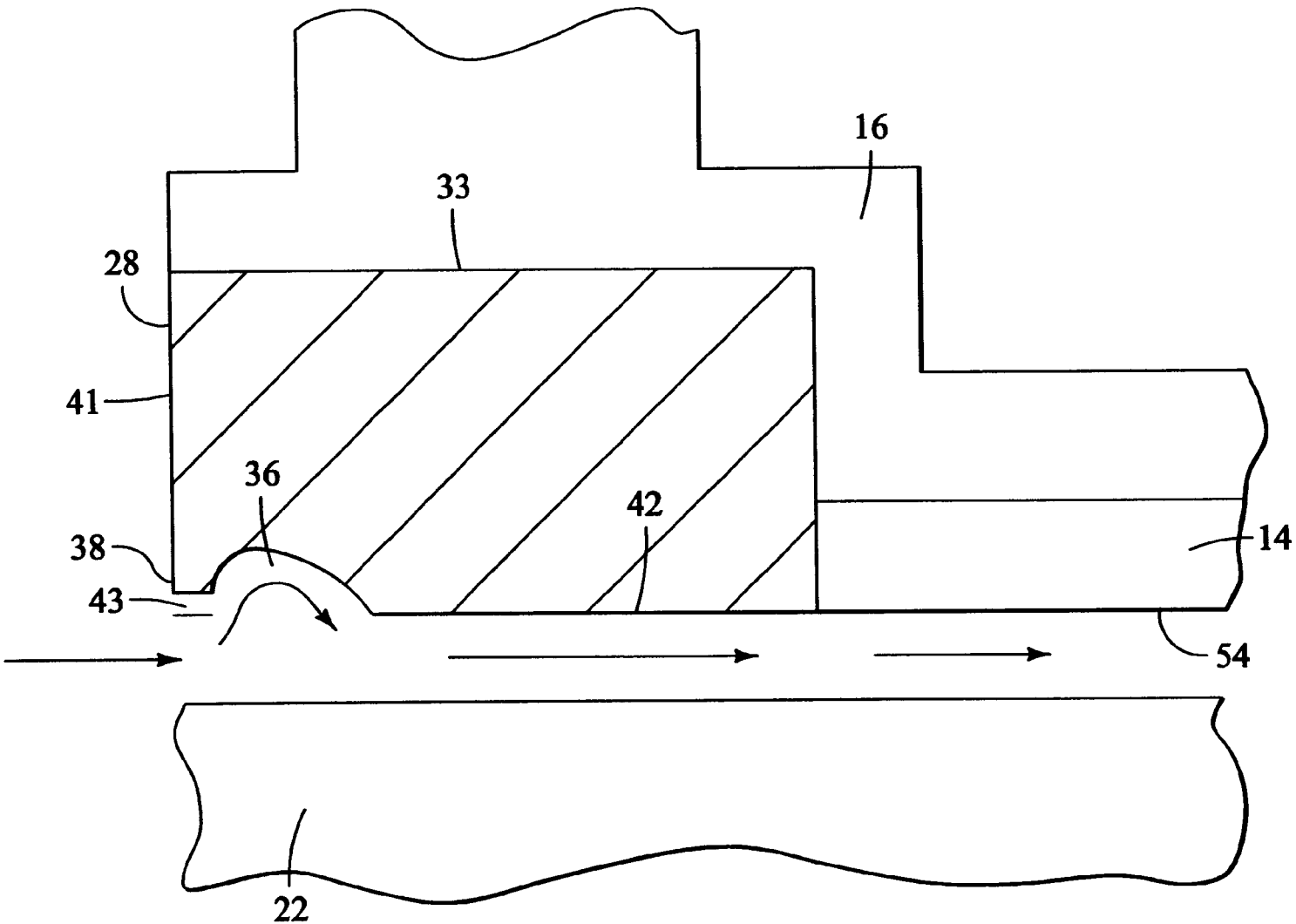
FIG. 5 is a cross-sectional view illustrating a portion of a substrate retainer and substrate carrier configured in accordance with an embodiment of the invention.

A portion of substrate carrier 16, substrate retainer 28 and polishing surface layer 22 are illustrated in cross-section in FIG. 5. As shown by the arrows, slurry generally flows along polishing surface layer 22 and into cavity 36. Cavity 36 cooperates with polishing surface layer 22 to provide a liquid reservoir in which a portion of the slurry is temporarily held. Under the continual translational motion of polishing surface layer 22 and the rotational motion of substrate retainer 28 and substrate carrier 16, the slurry flows from cavity 36 across face surface 42 of substrate retainer 28 and across an exposed surface 54 of substrate 14. As the polishing process proceeds, the polishing action of polishing surface layer 22 and the slurry removes portions of substrate 14 at exposed surface 54. The removed portions of exposed surface 54 are partially dissolved and entrained within the slurry. It is important to note that the thickness of the slurry layer is greatly exaggerated in FIG. 5 for purposes of illustration. In practice, surfaces 42 and 54 are in substantially direct contact with polishing surface layer 22.

As described above, when face surface 42 comes into contact with polishing surface layer 22, a gap 43 is formed between lip 38 and polishing surface layer 22. Gap 43 allows the used slurry that contains dissolved and entrained portions of exposed surface 54 to be removed from cavity 36 at the trailing edge of rotational cycle. Cavity 36 is positioned at the trailing edge when substrate carrier 16 rotates cavity 36 into a downstream position with respect to the general direction of slurry flow (shown by the directional arrows in FIG. 5). In the absence of gap 43, used slurry would become trapped in cavities 36 and 48. By providing for the release of used slurry, a fresh reservoir of slurry can be maintained within the cavities for enhanced polishing uniformity.

The cavity structure in the substrate retainer provides several advantages in a polishing operation. For example, the ability to hold a slurry reservoir at the perimeter of the substrate improves both the polishing removal rate and the substrate polishing uniformity. Also, the continuous flow of slurry from the cavity can reduce the total slurry consumption during substrate polishing. Further, the polishing variation associated with the placement of slurry delivery systems is reduced.

Those skilled in the art will appreciate that the functional aspects of the invention can be carried out with a variety of geometric configurations. For example, a plurality of cavities can be formed in the substrate retainer. The number of cavities used will depend upon several processing parameters, such as the diameter of the substrates being polished, the flow characteristics of the slurry, the slurry retention capability of the polishing pad, and the like. Further, although the cavity has been illustrated having a particular cross-sectional geometry, those skilled in the art will appreciate that various cross-sectional geometries can be implemented. For example, a rectangular shaped cross-sectional geometry, a square shaped cross-sectional geometry, a circular cross-sectional geometry, and the like can be used.

Additionally, the invention provides a uniform disbursement of slurry across the polishing pad downstream from polishing head assembly 10. This feature is important in a CMP apparatus that employs a pad conditioner in tandem with a polishing head assembly. By uniformly distributing slurry across the polishing pad downstream from the polishing head, the pad conditioner can more effectively condition the pad for subsequent polishing operations.

Thus, it is apparent that there has been described, in accordance with the invention, a polishing apparatus and substrate retainer ring providing continuous slurry distribution that fully provides the advantages set forth above. Although the polishing apparatus has been described and illustrated with reference to specific illustrative embodiments thereof, it is not intended that the invention be limited to those illustrative embodiments. For example, the polishing pad can be placed in rotational motion as the rotating head assembly is brought into contact with the polishing pad. Further, the cavity can be a plurality of circular depressions within the face surface of the substrate retainer. Those skilled in the art will recognize that other variations and modifications can be made without departing from the spirit of the invention. It is, therefore, intended to include within the invention all such variations and modifications as fall within the scope of the appended claims and equivalents thereof.

What is claimed is:

1. A substrate retainer for use in a polishing apparatus comprising:

a continuous annular member having a face surface and a perimeter surface; and a cavity for temporarily retaining and releasing portions of a polishing slurry, the cavity entirely formed in a portion of the face surface in proximity to but not intersecting the perimeter surface.

2. The substrate retainer ring of claim 1, wherein the cavity is configured to cooperate with a polishing surface in contact with the face surface to provide a liquid reservoir, and wherein the cavity has a wall surface at the perimeter surface that is offset from the face surface relative to the polishing surface.

3. The substrate retainer of claim 1, wherein the cavity comprises a hollowed out region in the face surface.

4. The substrate region of claim 1 further comprising a plurality of cavities each separated by a non-cavity containing portion of the face surface.

5. The substrate retainer of claim 1, wherein the cavity comprises an elongated channel in the face surface in spaced relationship with the perimeter surface.

6. The substrate retainer of claim 1, wherein the annular member further comprises a lip defining a distal wall surface of the cavity on a first side and a portion of the perimeter surface on a second side.

7. The substrate retainer of claim 1, wherein the annular member further comprises a central opening for receiving the substrate.

8. The substrate retainer of claim 7, wherein the annular member is configured to fit within a retainer receiving area of a substrate carrier such that a back surface of the substrate contacts the substrate carrier.

9. A substrate polishing head assembly comprising:

a substrate carrier having a perimeter and an annular indentation at the perimeter; and a substrate retainer having a face surface and and a perimeter surface and a cavity entirely formed in a portion of the face surface in proximity to but not intersecting the perimeter surface, wherein the substrate retainer is positioned within the annular indentation of the substrate carrier, the substrate carrier being configured to move in relation to a polishing surface supporting a polishing slurry, and wherein the cavity temporarily retains and releases a portion of the polishing slurry during the movement of the substrate carrier.

10. The substrate polishing head assembly of claim 9, wherein the substrate carrier further comprises a substrate support surface, and wherein the substrate retainer surrounds the substrate support surface.

11. The substrate of claim 10, wherein the cavity is configured to cooperate with a polishing surface in contact with the face surface to provide a liquid reservoir, and wherein the cavity has a wall surface that is offset from the face surface relative to the polishing surface.

12. The substrate polishing head of claim 9, wherein the substrate carrier further comprises a substrate support surface and wherein the retainer substrate retainer holds a substrate against the substrate support surface; and wherein the cavity releases slurry such that the slurry flows to the substrate during movement of the substrate carrier.

13. The substrate polishing head of claim 12, wherein the substrate carrier rotates in relation to the polishing surface.

14. A polishing apparatus comprising:

a polishing surface having a polishing slurry thereon;

a polishing head assembly coupled to a rotatable shaft; and a retainer ring engaged with the head assembly and having a face surface opposite to the polishing pad, wherein the face surface has a cavity therein, and wherein the cavity accommodates a portion of the slurry, such that during operation of the polishing apparatus slurry flows from the cavity onto the polishing pad, and wherein the cavity has a wall surface at a perimeter of the retainer ring that is offset from the face surface relative to the polishing surface such that polishing slurry can be released from the cavity during rotation of the polishing head.

15. The polishing apparatus of claim 14, wherein the retainer further comprises a perimeter surface, and wherein the cavity comprises an elongated channel in the face surface in spaced relationship with the perimeter surface.

16. The polishing apparatus of claim 15, wherein a plurality of cavities are each separated by a non-cavity containing portion of the face surface.

17. The polishing apparatus of claim 14, herein the head assembly further comprises a substrate carrier coupled to the rotatable shaft, wherein the substrate carrier has a perimeter surface and an annular indentation at the perimeter surface configured to receive a portion of the retainer ring.

18. The polishing apparatus of claim 17 further comprising an opening in the retainer ring for receiving a substrate, wherein the retainer ring is configured to hold the substrate against the substrate carrier, and wherein slurry flowing onto the polishing table from the cavity lubricates the substrate during rotation of the head assembly.

19. The polishing apparatus of claim 18, wherein the polishing table supports a polishing pad that is at least partially submerged in slurry flowing for the cavity.

* * * * *

UNITED STATES PATENT AND TRADEMARK OFFICE

CERTIFICATE OF CORRECTION

PATENT NO. : 6,447,380 B1 
DATED : September 10, 2002
INVENTOR(S) : Xuyen Pham et al.

It is certified that error appears in the above-identified patent and that said Letters Patent is hereby corrected as shown below:

Column 17,
Line 11, delete "herein" and substitute -- wherein -- in its place.

Signed and Sealed this

Twenty-second Day of April, 2003

JAMES E. ROGAN
*Director of the United States Patent and Trademark Office*